US009267727B2

(12) United States Patent
Lim et al.

(10) Patent No.: US 9,267,727 B2
(45) Date of Patent: Feb. 23, 2016

(54) REFRIGERATOR

(71) Applicant: LG Electronics Inc., Seoul (KR)

(72) Inventors: Kiyoung Lim, Seoul (KR); Yongun Park, Seoul (KR); Jinwon Kang, Seoul (KR); Woonkyu Seo, Seoul (KR); Daesung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/452,653

(22) Filed: Aug. 6, 2014

(65) Prior Publication Data

US 2015/0069900 A1 Mar. 12, 2015

(30) Foreign Application Priority Data

Sep. 9, 2013 (KR) ..... 10-2013-0107762

(51) Int. Cl.
*F25D 23/02* (2006.01)
*F25D 23/00* (2006.01)
*E05C 3/16* (2006.01)

(52) U.S. Cl.
CPC ..... *F25D 23/028* (2013.01); *F25D 23/00* (2013.01); *F25D 23/025* (2013.01); *E05C 3/162* (2013.01); *F25D 2323/023* (2013.01)

(58) Field of Classification Search
CPC ..... F25D 23/02; F25D 23/025; F25D 23/028; F25D 23/04; F25D 2323/02; F25D 2323/023
See application file for complete search history.

(56) References Cited

U.S. PATENT DOCUMENTS 2,131,680 A * 9/1938 Zahodiakin ..... 62/266
2,150,064 A * 3/1939 Robert et al. ..... 62/266
2,276,937 A * 3/1942 Cordova ..... 222/130
3,208,641 A * 9/1965 Brugioni ..... 222/108
3,218,111 A * 11/1965 Steiner ..... 312/405.1
4,072,486 A * 2/1978 Joseph ..... 62/131
6,079,216 A * 6/2000 de Marsillac Plunkett et al. ..... 62/56
2005/0138956 A1* 6/2005 Okuda et al. ..... 62/441
2006/0226751 A1* 10/2006 Park ..... 312/405.1

(Continued)

FOREIGN PATENT DOCUMENTS

GB 2291461 A 1/1996
JP 2000249462 A 9/2000

(Continued)

OTHER PUBLICATIONS

Search Report dated May 18, 2015 from corresponding European Patent Application No. 14179903.1, 7 pages.

*Primary Examiner* — Daniel Rohrhoff
(74) *Attorney, Agent, or Firm* — Fish & Richardson P.C.

(57) ABSTRACT

A refrigerator includes a cabinet, a main door, an auxiliary storage compartment provided to a rear surface of the main door, and a sub-door. The main door is rotatably connected to the cabinet, and the sub-door is rotatably connected to the main door. An access opening is provided in the main door to allow access to the auxiliary storage compartment. The refrigerator also includes a button exposed at a front surface of the sub-door to receive input provided by a user, a hook member having a pivot shaft mounted to its rear end, and a locking protrusion provided in a groove located on a front surface of the main door that can selectively couple to the hook member. The hook member protrudes backward from a rear surface of the sub-door and can rotate within the sub-door about the pivot shaft in response to receipt of user input at the button.

19 Claims, 13 Drawing Sheets

(56) References Cited

U.S. PATENT DOCUMENTS

| | | | | |
|---|---|---|---|---|
| 2010/0307188 | A1* | 12/2010 | Kwon et al. | 62/441 |
| 2011/0146324 | A1* | 6/2011 | Lee et al. | 62/344 |
| 2012/0062093 | A1* | 3/2012 | Lee et al. | 312/405 |
| 2013/0026900 | A1* | 1/2013 | Oh et al. | 312/401 |
| 2013/0033163 | A1 | 2/2013 | Kang | |
| 2013/0049562 | A1 | 2/2013 | Jung et al. | |
| 2013/0111941 | A1* | 5/2013 | Yu et al. | 62/407 |
| 2014/0232251 | A1* | 8/2014 | Kim et al. | 312/404 |
| 2014/0239790 | A1* | 8/2014 | Yoo et al. | 312/404 |

FOREIGN PATENT DOCUMENTS

| | | | |
|---|---|---|---|
| KR | 2013053318 | A | 5/2013 |
| WO | W02011081279 | A1 | 7/2011 |

* cited by examiner

REFRIGERATOR

CROSS-REFERENCE TO RELATED APPLICATION

This application claims the benefit of the Korean Patent Application No. 10-2013-0107762, filed on Sep. 9, 2013, which is hereby incorporated by reference as if fully set forth herein.

TECHNICAL FIELD

The present application relates to a refrigerator and, more particularly, to a refrigerator with a double door structure having a decoupling device of high strength and durability between two doors.

BACKGROUND

Generally, a refrigerator is an appliance for storing food and the like in a frozen or refrigerated state within a storage compartment by discharging, into the storage compartment, cold air generated through a refrigeration cycle constituted by a compressor, a condenser, an expansion valve, an evaporator, etc.

The refrigerator generally includes a freezer compartment for storage of food or beverages in a frozen state in a cabinet, and a fresh food compartment for storage of food or beverages at low temperature.

Refrigerators may generally be classified into a top mount type refrigerator, a bottom freezer type refrigerator and a side-by-side type refrigerator. In the top mount type refrigerator, a freezer compartment is arranged above a fresh food compartment. In the bottom freezer type refrigerator, the freezer compartment is arranged under the fresh food compartment. In the side-by-side type refrigerator, the freezer compartment and the fresh food compartment are arranged side by side.

More recently, various functions have been added to the refrigerator in addition to the function of storing food in a refrigerated or frozen state. For example, a dispenser may be installed at the door of a refrigerator to provide purified water and ice, or a display may be installed on the front surface of the door to display the state of the refrigerator so as to manage the refrigerator.

In addition, the volume of the refrigerator has been increased, and a door shelf or accommodation case to store objects has been provided to the inner side of the door so as to efficiently utilize the accommodation space.

Particularly, a fresh food compartment door may include a main door to open and close the compartment, and a sub-door rotatably mounted to the main door to allow access to an auxiliary storage compartment provided to the inner side of the main door through an opening formed in the main door. The auxiliary storage compartment at the inner side of the main door may be called a home bar, and the sub-door may be called a home bar door.

SUMMARY

Accordingly, an object of the present application is to provide a refrigerator having a device that has a simplified structure for selective decoupling between a main door and a sub-door, that is easy to fabricate and assemble, and/or that has high shock resistance and durability.

Additional advantages, objects, and features of the application will be set forth in part in the description which follows and in part will become apparent to those having ordinary skill in the art upon examination of the following or may be learned from practice of the application. The objectives and other advantages of the application may be realized and attained by the structure particularly pointed out in the written description and claims hereof as well as the appended drawings.

According to one aspect, a refrigerator includes a cabinet defining a storage compartment, a main door having a front surface and a rear surface, the main door being rotatably connected to the cabinet and configured to open and close the storage compartment, an auxiliary storage compartment provided to the rear surface of the main door, an access opening being provided in the main door to allow access to the auxiliary storage compartment from the front surface of the main door, and a sub-door having a front surface and a rear surface, the sub-door being rotatably connected to the main door and configured to open and close the access opening such that, based on the sub-door being oriented in a closed position, the rear surface of the sub-door contacts the front surface of the main door to close the access opening. The refrigerator also includes a button exposed at the front surface of the sub-door and configured to receive input provided by a user, a hook member having a pivot shaft mounted to a rear end the hook member, the hook member protruding backward from the rear surface of the sub-door and being configured to rotate within the sub-door about the pivot shaft in response to receipt of user input at the button, and a locking protrusion provided in a groove located on the front surface of the main door and configured to be selectively coupled to the hook member.

Implementations of this aspect may include one or more of the following features. For example, the refrigerator may include a link member coupled to the hook member and configured to rotate together with the hook member in response to receipt of user input at the button. The refrigerator may include a case installed through the sub-door such that the button protrudes from a front surface of the sub-door and the hook member protrudes backward from the sub-door. The refrigerator may include a slide member provided between the button and the link member, and the slide member may be guided to move back and forth in the case. The case may include a first case defining a through hole that receives a portion of the button and allows the button to move back and forth. The first case may be provided with a guide groove configured to guide movement of the slide member, and a second case that is provided with a pivot shaft hole in which the pivot shaft of the hook member is mounted and that defines an opening allowing the hook member to pass therethrough. The opening of the second case may vertically extend to allow rotation of the hook member. The refrigerator may include a first elastic member and an extension extending from the pivot shaft of the hook member in a direction opposite from the link member. The first elastic member may be configured to return the hook member to an original position of the hook member based on locking of the hook member being released. The refrigerator may include a second elastic member provided between an interior of the case and the button. The second elastic member may be configured to return the button to an original position of the button following receipt of user input at the button. The second elastic member may be installed through a hole in the link member. The second elastic member may have a higher modulus of elasticity than that of the first elastic member such that the hook member returns to the original position thereof after the button returns to the original position thereof. An inner surface of the case may be provided with a guide groove arranged in a horizontal direction. The slide member may include a guide protrusion slidably guided by the guide groove. The slide member may be larger than the through hole and restricted by an edge of the through hole such that a maximum distance of forward movement of the slide member is limited. The locking protrusion may have a shape of a wedge extending downward in the case that is mounted within the main door, and the locking protrusion may include a convex guide surface provided to a front side thereof and a concave locking surface provided to a back side thereof. The hook member may define a through hole allowing the locking protrusion to be selectively inserted in the through hole and includes a cylindrical hook provided to an end of the hook member. The hook member may include a body part horizontally extending from the pivot shaft, a front portion of the body part being formed in a shape of a bracket, and the hook may be rotatably mounted to a front end of the body part. A distance from the pivot shaft of the hook member to the hook may be at least twice a distance from the pivot shaft to a point on the extension that intersects a straight line passing through a center of the first elastic member. The refrigerator may include a cover mounted in an opening in the rear surface of the sub-door to allow the case to be mounted, and the cover may define a through hole extending vertically to allow rotation of the hook member through the cover.

Implementations of this aspect may also include one or more of the following features. For example, a refrigerator may have a repulsive device provided to the sub-door or the main door to cause the sub-door to be spaced a predetermined distance from the main door based on the hook member and the locking protrusion being decoupled from each other in response to receipt of user input at the button. The repulsive device may include a case defining a through hole at one side of the case, a repulsive member arranged in the case such that a front portion of the repulsive member is guided to protrude through the through hole, and an elastic member provided in the case and configured to push the repulsive member toward the through hole. The button may be configured to receive input by being pushed by the user.

It is to be understood that both the foregoing general description and the following detailed description of the present application are exemplary and explanatory and are intended to provide further explanation of the application as claimed.

BRIEF DESCRIPTION OF THE DRAWINGS

The accompanying drawings, which are included to provide a further understanding of the application and are incorporated in and constitute a part of this application, illustrate implementation(s) of the application and together with the description serve to explain the principle of the application. In the drawings.

Like reference symbols in the various drawings indicate like elements.

DETAILED DESCRIPTION

Figure 1:
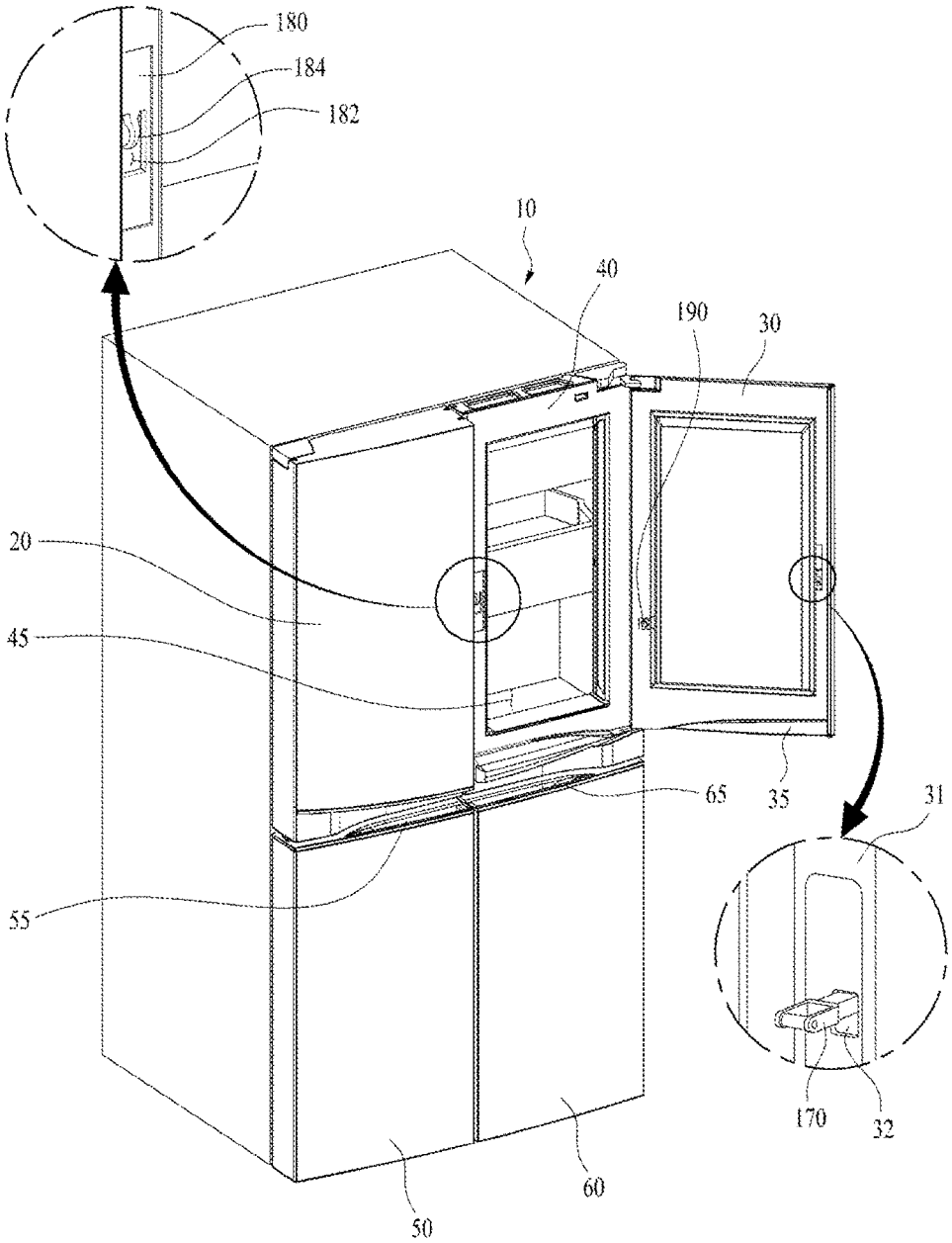
FIG. 1 is a perspective view illustrating an example refrigerator according to one implementation of the present disclosure.

FIG. 1 illustrates a refrigerator according to one implementation of the present disclosure. While the illustrated refrigerator is a bottom freezer type refrigerator having a fresh food compartment arranged at the upper portion of a cabinet 10 and a freezer compartment arranged at the lower portion of the cabinet 10, implementations of the present application are not limited to this type of refrigerator. The present application is applicable to any refrigerator provided with a door to open and close a storage compartment of the refrigerator. As illustrated, a left fresh food compartment door 20 and right fresh food compartment door are rotatably installed as doors to open and close the fresh food compartment.

As shown in FIG. 1, the right fresh food compartment door includes a main door 40 to open and close the right part of the fresh food compartment and a sub-door 30 rotatably mounted to the main door 40. An opening is formed at the central portion of the main door 40, and an auxiliary storage compartment 45 is provided to the rear surface of the main door 40. The sub-door 30 opens and closes the auxiliary storage compartment 45. The fresh food compartment door includes the main door and the sub-door which have a width corresponding to that of the cabinet 10 and are not divided to be opened to the left and right sides. The main door and the sub-door may be rotatably installed.

A door to open and close the freezer compartment includes a left freezer compartment door 50 and a right freezer compartment door 60. The freezer compartment door may be provided with one rotatably installed door or a drawer type door which is movable back and forth.

A recessed part for a door handle may be formed at the lower portion of each of the fresh food compartment doors 20 and 30. The lower surfaces of the recessed part, namely the upper surfaces of the freezer compartment doors 50 and 60 are provided with handle grooves 55 and 65, respectively. Each of the lower surfaces of the fresh food compartment doors 20 and 30 is also provided with a handle groove 35 (the handle groove for the left compartment is not shown).

The handles of the doors may be coupled to the front surfaces of the doors in a protruding manner. In some cases, the handles may not be protruded forward so as not to degrade aesthetics of the exterior of the refrigerator, as in the illustrated implementation.

As shown in FIG. 1, which shows the sub-door 30 in an open state, the right edge of the sub-door 30 is provided with a hook member 170 having an end protruding through a through hole formed in a cover 31. The hook member 170 is rotatably mounted to the interior of the sub-door 30.

The left edge of the main door 40 is provided with a locking protrusion 184 selectively coupled to the hook member 170. The locking protrusion 184 may be integrated with a case 180, which is mounted to a recessed part formed at the left edge of the main door 40. The central portion of the case 180 may be provided with an opening 182, and the locking protrusion 184 may extend downward from an upper portion of the opening 182, forming a wedge shape.

The left edge of the sub-door 30 may be provided with a repulsive device 190. The repulsive device 190 is configured to space the sub-door 30 from the main door 40 by a predetermined distance when the locking state of the hook member 170 and the locking protrusion 184 is released. The structure of the repulsive device 190 will be described in detail below.

Figure 2:
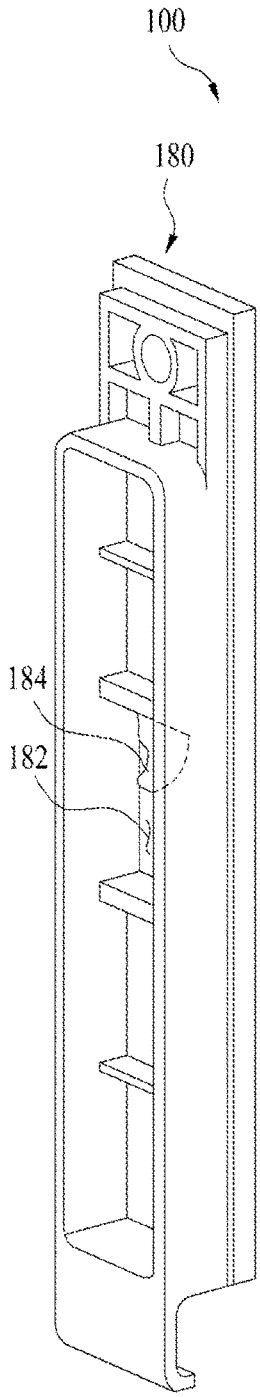
FIG. 2 is a perspective view illustrating a locking protrusion case constituting a decoupling device for a main door and a sub-door.
Figure 4:
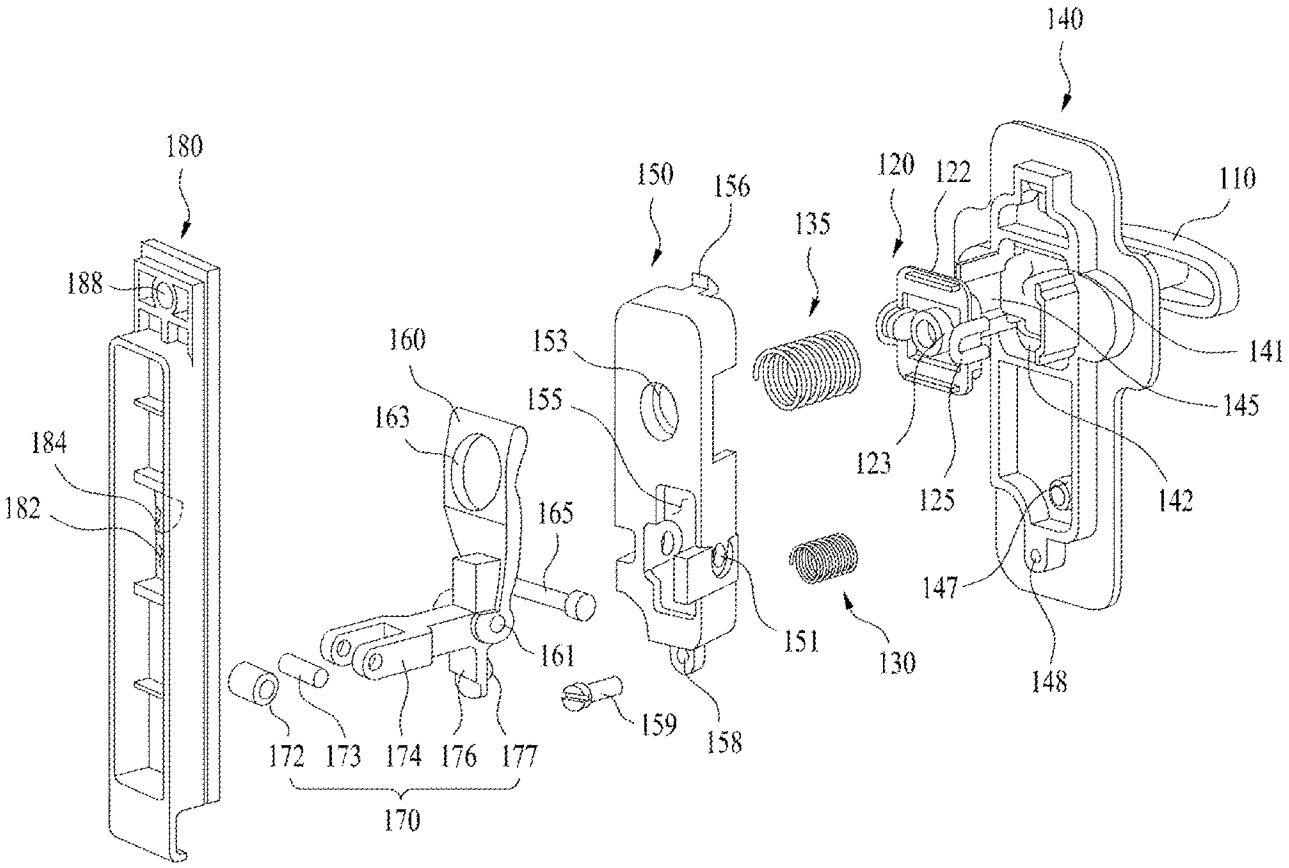
FIG. 4 is an exploded perspective view illustrating the locking protrusion case of FIG. 2 and the hook member assembly of FIG. 3A.

As shown in FIGS. 2 and 4, the central portion of the locking protrusion case 180 is provided with an opening 182 and the locking protrusion 184 extends downward from the ceiling of the opening 182. The case 180 may be installed by being inserted into a recessed part formed at the left edge of the main door 40. The upper portion of the case 180 may be provided with a fastening hole 188 allowing a screw to be fastened therethrough. The locking protrusion case 180 is a structure configured to fix the locking protrusion 184 to the groove of the main door 40, and may be formed in various shapes rather than being limited to the illustrated shape.

Figure 3A:
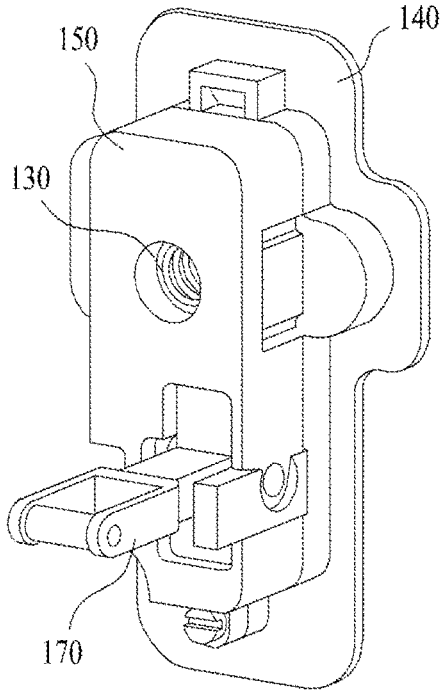
FIGS. 3A and 3B are perspective views illustrating a hook member assembly constituting the decoupling device for the main door and the sub-door.
Figure 3B:
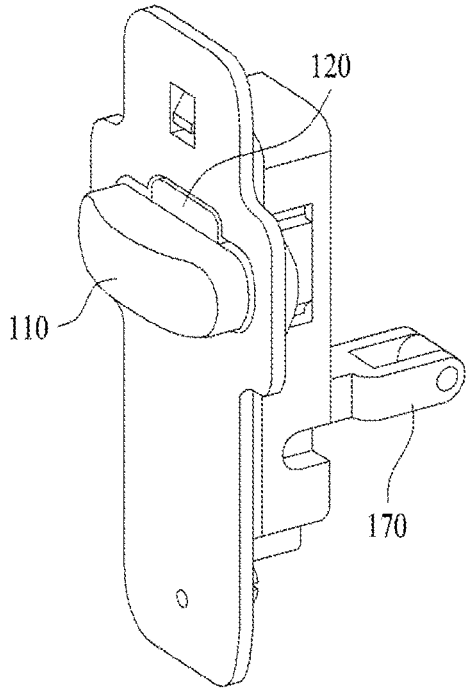

As shown in FIGS. 3A, 3B, and 4, the hook member assembly allows the hook member 170 protruding from the rear surface of the sub-door 30 to rotate when a user pushes a button 110 exposed on the front surface of the sub-door 30.

To this end, the hook member assembly includes the button 110 exposed on the front surface of the sub-door 30, a hook member 170 provided, at a rear end thereof, with a pivot shaft rotatably mounted to the interior of the sub-door and protruding backward from the rear surface of the sub-door to be rotated by pushing the button, and a locking protrusion 184 provided to the interior of a groove formed on the front surface of the main door so as to be selectively coupled to the hook member.

The hook member assembly may be mounted through the sub-door 30 such that the button 110 and the hook member 170 protrude from the front surface and rear surface of the sub-door 30, respectively. In some cases, components of the hook member assembly are installed in the case mounted to the interior of the sub-door 30. The case may include a first case 140 allowing the button 110 to protrude from the front surface thereof and a second case 150 installed such that the hook member 170 protrudes backward.

The first case 140 is provided with a through hole 141 into which a portion of the button 110 is inserted such that back-and-forth movement of the button 110 is guided. The button 110 is wider than the through hole 141 of the first case 140 in the lateral direction, and recessed parts are formed on the left and right sides of the through hole 141 to allow the button 110 to be seated and supported thereon when the button 110 is pushed.

The second case 150 is provided with an opening 155 allowing the hook member 170 to pass therethrough and protrude backward. The upper end of the second case 150 may be coupled with a hook coupling unit which is provided with a coupling hook 156 and formed at the upper portion of the first case 140. In addition, a fastening hole 158 may be provided to the lower end of the second case 150, and a fastening hole 148 may be provided to the lower portion of the first case 140. As such, the second case 150 and the first case 140 may be fastened by a screw 159.

The hook member 170 is rotatably mounted to the interior of the second case 150. The hook member 170 may be coupled to a link member 160 configured to rotate together with the hook member 170 when the button 110 is pushed.

The hook member 170 and the link member 160 may be integrated with each other, or may be separately fabricated and coupled to each other by a fastening member such as a screw. Since the hook member 170 and the link member 160 can have complex shapes, it may not be easy to integrate the two. Accordingly, the hook member 170 and the link member 160 may be fabricated separately and coupled to each other.

The lower end of the link member 160 may be provided with a pivot shaft hole 161, and a pair of pivot shaft holes 151 may be provided to both sides of the opening 155 of the second case 150. As such, a pivot pin 165 may be inserted into the pivot shaft hole 161 and pivot shaft holes 151 to install the hook member 170 and the link member 160. In some cases, the opening 155 of the second case 150 vertically extends to allow rotation of the hook member.

The hook member 170 horizontally extends from the pivot shaft hole 161. The hook member 170 may include a body part 174 having a bracket-shaped (ㄷ-shaped or in the shape of a "[") front portion, a fastening pin 173 horizontally inserted into a pair of holes formed in the front end of the body part 174, and a hook 172 mounted to the front end of the body part 174 by the fastening pin 173.

Through holes into which the locking protrusion 184 is selectively inserted are formed in the bracket-shaped (ㄷ-shaped or in the shape of a "[") front end of the body part 174 of the hook member 170 and the hook 172. The hook 172 is formed in a cylindrical shape to ensure smooth coupling and decoupling between the hook 172 and the locking protrusion 184.

In some cases, the hook 172 may be integrated with the body part 174. However, as the hook 172 is rotatably mounted to the end of the body part 174 by the fastening pin 173, smoother operation of the hook 172 may be enabled when the hook 172 contacts the locking protrusion 184.

Figure 6:
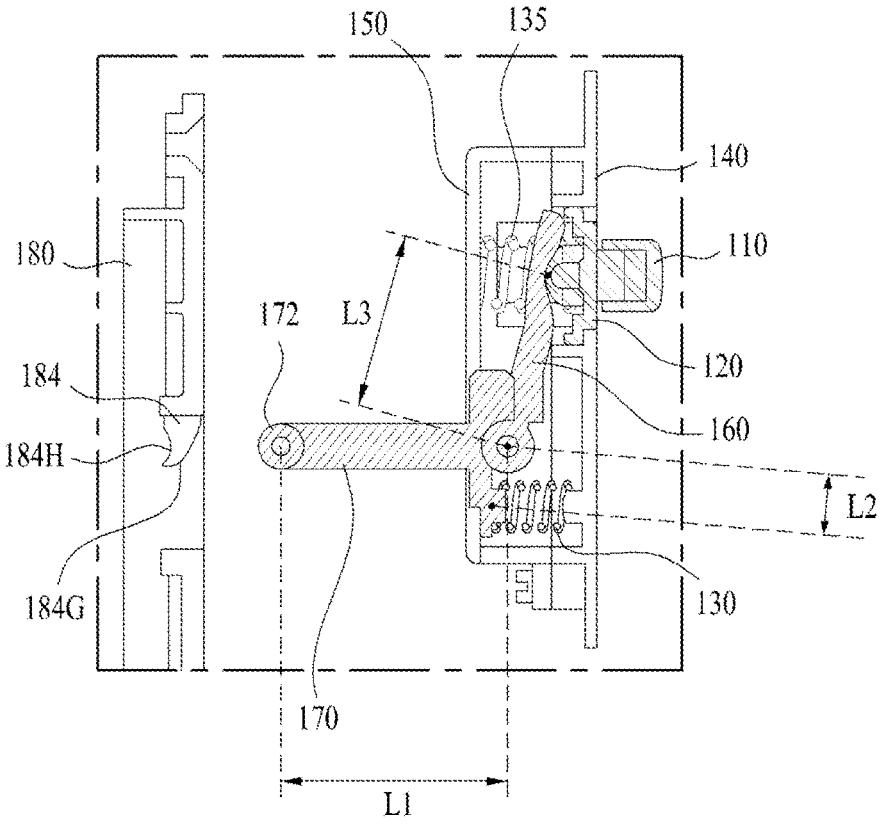
FIG. 6 is a transverse cross-sectional view illustrating a decoupling device.

In some cases, as shown in FIG. 6, the locking protrusion 184 may include a convex guide surface 184G formed on the front thereof and a concave restricting surface 184H formed on the back thereof. When the hook member 170 enters the opening 182 upon being hit by the locking protrusion 184, the hook 172 may be guided to smoothly move downward by sliding on the guide surface 184G.

If the hook 172 is formed in a cylindrical shape, as illustrated, the restricting surface 184H may be provided with a concave surface corresponding to the circumferential surface of the hook 172. Accordingly, the hook member 170 may be prevented from being released from the hooked state even when the hook member 170 is horizontally pulled.

In some cases, the button 110 may push the link member 160 by directly contacting the link member 160. A slide member 120 may be provided between the button 110 and the link member 160 and may be guided to move back and forth in the case.

The overall shape of the slide member 120 may be quadrangular and a coupling structure allowing the slide member 120 to be coupled with the button 110 may be provided to the front of slide member 120. Accordingly, when the button 110 and the slide member 120 are coupled to each other, the coupled portions thereof may be disposed in the through hole with the first case 140 placed therebetween.

A pair of extensions extending inward is formed at both sides of the through hole 141 of the first case 140, and the slide member 120 is slidably installed between guide grooves 145 formed on the inner surfaces of the extensions to face each other. To this end, both side parts of the slide member 120 may be provided with a pair of guide ribs 125 slidably inserted into the guide grooves 145. The guide ribs 125 may be formed in a rounded bracket shape (⊂ shape). In some cases, the entire slide member 120 may be integrally formed.

The vertical size of the slide member 120 is larger than the vertical size of the through hole 141. Thereby, when the slide member 120 moves forward, the slide member 120 may be supported by the support ribs 142 formed at the upper and lower portions of the through hole 141. Extensions 122 extending upward and downward may be formed at the upper end and lower end of the slide member 120. Thereby, the front surfaces of the extensions 122 may be supported by the support ribs 142. Hence, the slide member 120 can move forward together with the button only until it contacts the support rib 142 configured to support the side member 120, and thus maximum forward movement thereof may be limited. The maximum backward movement of the slide member 120 may be limited by the second case 150 and a second elastic member 135, which will be described later.

The refrigerator may further include a first elastic member 130 provided between the interior of the case 140 and one end of the hook member 170 to return the hook member to the original position thereof when the hook member is released from the locking state. As described above, the hook member 170 may be coupled with the link member 160 and rotatably mounted to the second case 150. At this time, the first elastic member 130 may be installed between the interior of the first case 140 and one end of the hook member 170. The inner surface of the first case 140 may be provided with a mounting protrusion 147 allowing the first elastic member 130 to be mounted thereto. In addition, the hook member 170 may be provided with an extension 176 extending downward from the pivot shaft, and the front surface of the extension may be provided with a mounting protrusion 177 allowing the first elastic member 130 to be mounted thereto.

While the first elastic member 130 is illustrated as being a coil spring, any type of spring such as a torsion spring may be used so long as it can rotate the hook member 170 to the original position thereof in a direction opposing the direction in which the hook member 170 rotates when released from the locking state.

The refrigerator may further include a second elastic member 135 provided between the interior of the case and the button 110 to return the button to the original position thereof after the button is pushed. The second elastic member 135 may be installed between the interior of the second case 150 and the button 110. In this case, the slide member 120 is not provided as a separate member, but the button 110 is slidably mounted to the inner side of the first case 140. As described above, in the case in which the slide member 120 is provided as a separate member and coupled to the button 110 with the first case 140 placed between the slide member 120 and the first case 140, the second elastic member 135 is installed between the interior of the second case 150 and the inner side of the slide member 120. The inner side of the second case 150 may be provided with a mounting protrusion 153 allowing one end of the second elastic member 135 to be mounted thereto. In addition, the inner side of the slide member 120 may also be provided with a mounting protrusion 123 allowing the other end of the second elastic member 135 to be mounted thereto.

As shown in FIG. 4, the mounting protrusion 123 may protrude forward along the edge of a hole smaller than the second elastic member 135. While the second elastic member 135 is illustrated as taking the form of a coil spring, it may take other forms.

Since the second elastic member 135 is configured to return the button 110 to the original position thereof with respect to the second case 150, force of the second elastic member 135 should not be applied to the link member 160. Accordingly, the second elastic member 135 may be installed by passing through a hole 163 formed in the link member 160. The hole 163 may be larger than the second elastic member 135 such that the link member 160 does not interfere with the second elastic member 135 when rotated by a predetermined angle. The second elastic member 135 may have a modulus of elasticity higher than that of the first elastic member 130 such that the hook member 170 returns to the original position thereof after the button 110 returns to the original position thereof.

As shown in FIG. 3, the second elastic member 135 has a larger diameter than the first elastic member 130, which means that the modulus of elasticity of the second elastic member 135 is higher than that of the first elastic member 130. Accordingly, resilience of the second elastic member 135 is higher than that of the first elastic member 130. Therefore, when the hook member 170 is decoupled from the locking protrusion 184 by pushing the button 110, the button 110 is first returned to the original position thereof by the second elastic member 135, and then the hook member 170 is rotated to the original position thereof by the first elastic member 130. Accordingly, when the user releases the button 110, the hook member 170 may immediately recover the original shape thereof, thereby preventing re-coupling with the locking protrusion.

Figure 5:
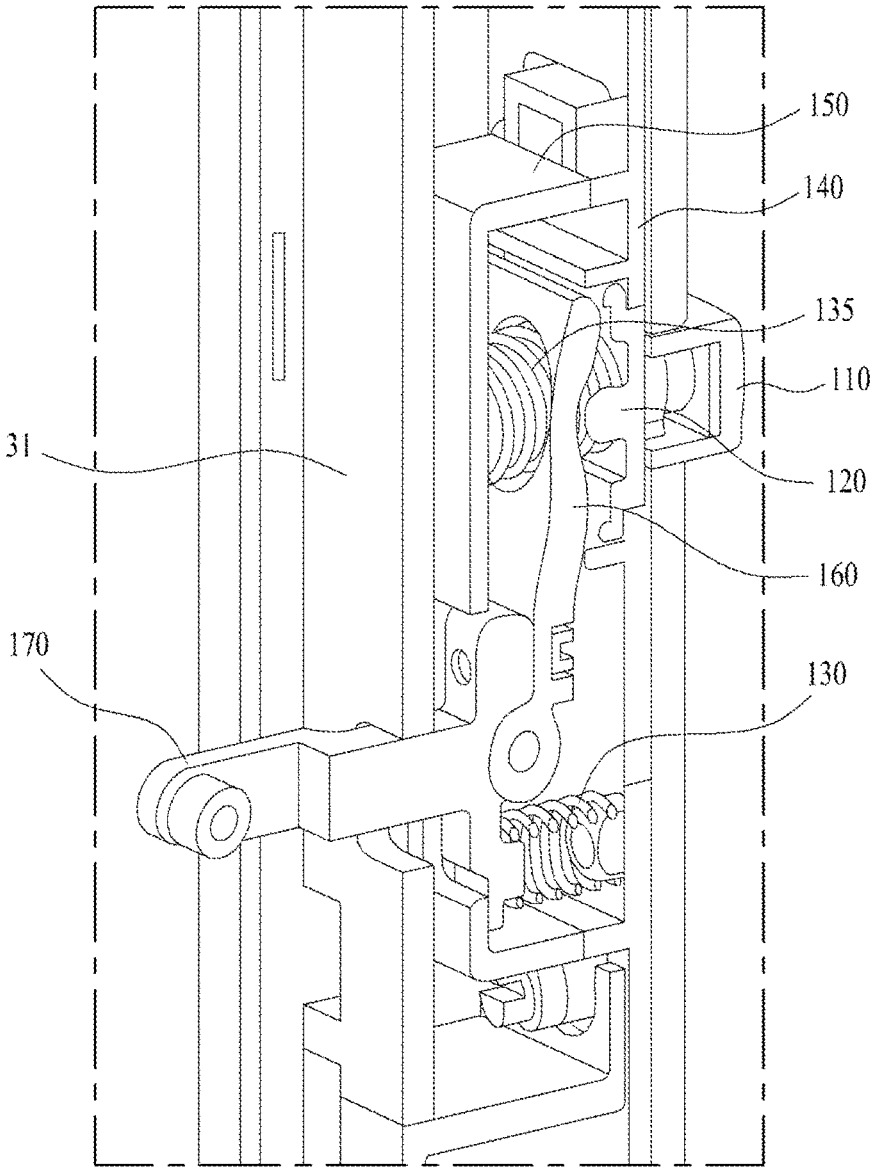
FIG. 5 is an open perspective view illustrating mounting of the hook member assembly to a door.

FIG. 5 illustrates mounting of the hook member assembly to the door 30, and FIG. 6 illustrates the decoupling device.

FIG. 5 is seen from a cross-sectional plane that extends across the button 110, the slide member 120, the first elastic member 130, the first case 140, the second case 150, the link member 160 and the hook member 170, but not across the second elastic member 135. That is, when viewed from the back, the second elastic member 135 may be disposed further to the left than the first elastic member 130. Additionally, the link member 160 and the hole 163 formed therein may be disposed on the left side of the lateral center of the hook member 170.

As shown in FIG. 6, the length L1 from the pivot shaft of the hook member 170 to the hook 172 may be two times or more the length L2 from the pivot shaft to a point on the extension 176 that meets a line passing through the center of the first elastic member 130. Thus, as the length L1 from the pivot shaft of the hook member 170 to the center of the hook 172 is even greater than the length L2 from the pivot shaft to the point on the extension 176 to which the first elastic member 130 applies elastic force, the hook member 170 is caused to slowly rotate when returning to the original position thereof. As such, until the hook 172 fully escapes from the locking protrusion 184, restoration of the hook member 170 is not completed. Accordingly, even if the user releases the button 110, the hook 172 may be prevented from being re-caught by the locking protrusion 184. In addition, the length L3 from the pivot shaft of the length of the hook member 170 to the point on the link member 160 to which the slide member 120 applies pushing force may be similar to the length L1 from the pivot shaft of the hook member 170 to the hook 172.

When the user pushes the protruding button 110 on the sub-door 30 (see FIG. 1) with the button 110 coupled to the slide member 120, the second elastic member 135 is compressed, and the slide member 120 pushes the link member 160. Then, the hook member 170 coupled to the link member 160 rotates, releasing locking of the locking protrusion. At this time, the first elastic member 130 is also compressed as the hook member 170 rotates.

When the user releases the button 110, the second elastic member 135 acts first, and thus the slide member 120 and the button 110 return to the original positions thereof. Thereafter, the first elastic member 130 returns the hook member 170 to the original position thereof.

The sub-door 30 may further include a cover 31 mounted to the opening of the rear surface of the sub-door 30 which allows the case to be mounted therein. The cover 31 may be provided with a long through hole 32 extending in a vertical direction to allow the hook member 170 to pass therethrough and rotate. The hook member 170 may be held horizontally by the first elastic member 130. When the user pushes the button 110, the hook member 170 rotates downward. Accordingly, as shown in FIG. 1, the through hole 32 may extend downward from the position through which the hook member 170 passes. As such, the upper end of the through hole 32 may restrict upward rotation of the hook member 170, and the lower portion of the through hole 32 may allow downward rotation of the hook member 170.

In some cases, a repulsive device 190 may be provided to the sub-door 30 or the main door 40 to space the sub-door 30 a predetermined distance from the main door 40 when the button 110 is pushed to decouple the hook member 170 from the locking protrusion 184.

Figure 7:
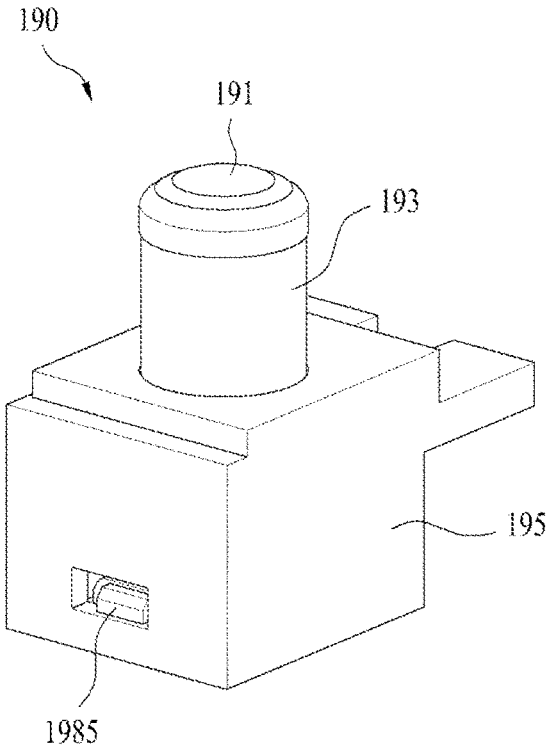
FIG. 7 is a perspective view illustrating a repulsive device.
Figure 8:
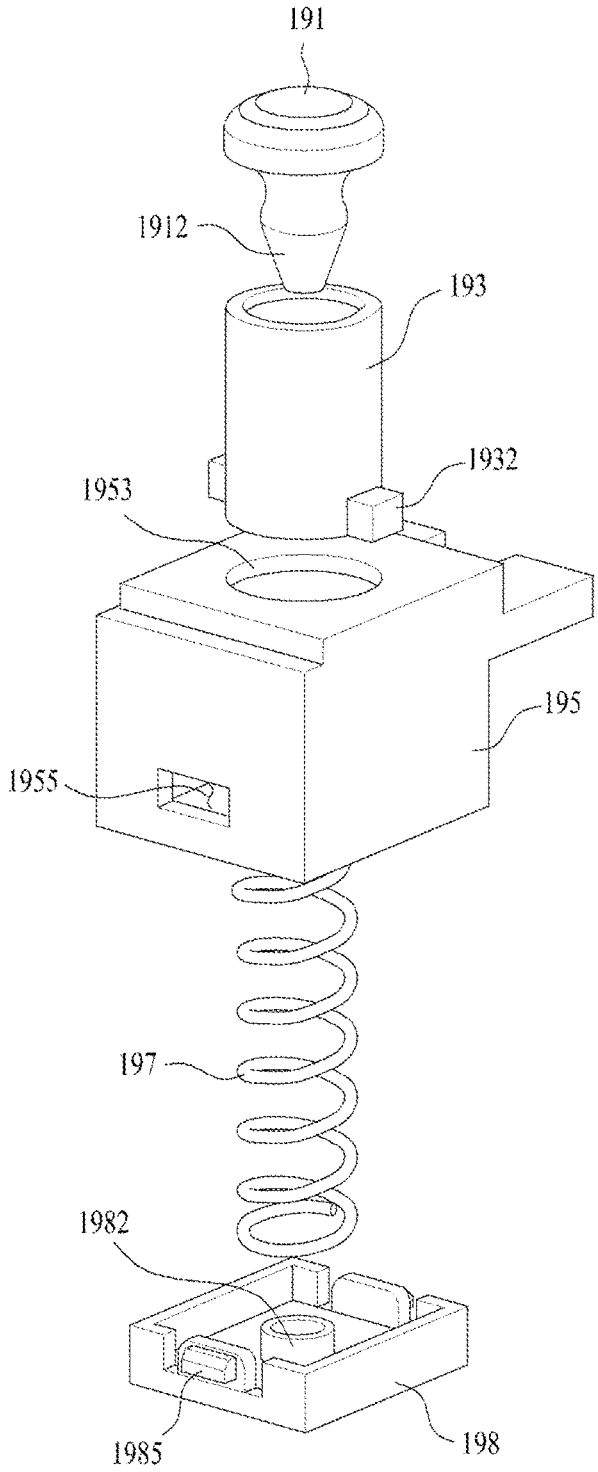
FIG. 8 is an exploded perspective view illustrating the repulsive device.

FIGS. 7 and 8 illustrate a repulsive device 190. While the repulsive device 190 is illustrated as being mounted to the interior of the sub-door 30 in FIG. 1, it may be mounted to the interior of the main door 40. Since the sub-door 30 is opened and closed by rotating relative to the main door 40, the repulsive device 190 may be disposed at the inner side of the sub-door 30. The inner side of the sub-door 30 is provided with a recessed part for insertion of the repulsive device 190. The repulsive device 190 may be inserted into the recessed part and then fastened with, for example, a screw through the fastening hole formed at one side of the recessed part.

The repulsive device 190 may include a case 195, as shown in FIG. 7. A portion of the case 195 extending to the right side may be provided with a fastening hole for fastening of the screw. The case 195 may have a through hole 1953 at one side, a repulsive member 191 whose front portion protrudes through the through hole in the case, and an elastic member 197 provided in the case to push the repulsive member toward the through hole. A portion of the repulsive member 191 and the elastic member 197 should be mounted in the case 195. Accordingly, the case 195 is not independently formed but in some cases may be coupled to the cover 198, as shown in FIG. 8.

A pair of elastically deformable protrusions 1985 may be provided to both sides of the cover 198, and a pair of coupling holes 1955 may be provided to both side surfaces of the case 195. Thereby, the protrusions 1985 may be coupled to the coupling holes 1955 by being inserted into the coupling holes 1955.

The case 195 may be formed in the shape of a hexahedron, and the through hole 1953 may be formed in the front surface of the case 195 in a circular shape. The repulsive member 191, which may also be independently provided, may be coupled to a guide member 193 to which the repulsive member 191, which contacts the inner surface of another door, is mounted to slide in the case 195.

In operation, the repulsive member 191 pushes the inner surface of the door, and may be formed of an elastic material such as rubber. In contrast, the guide member 193 may be formed of plastics producing low friction since the guide member 193 slides in the through hole 1953 of the case 195. Accordingly, the repulsive member 191 may not be a unitary structure, but rather may be constructed by fabricating and coupling members of different materials exhibiting different characteristics.

The repulsive member 191 may be coupled to the guide member 193 formed in the shape of a hollow pipe by being press-fitted into the guide member 193. A portion of the repulsive member 191 inserted into the guide member 193 may be provided with a mounting protrusion 1912 to which one end of the elastic member 197 is mounted. The interior of the cover 198 may be provided with a mounting protrusion 1982 to which the other end of the elastic member 197 is mounted. In addition, at least one protrusion 1932 may be integrally provided to both sides of the outer circumferential surface of one end of the guide member 193 in order to prevent the guide member 193 from being fully separated from the case 195 when the elastic member 197 pushes the repulsive member 191 coupled to the guide member 193.

Hereinafter, an example operation of the decoupling device according to one implementation will be described in detail with reference to FIGS. 9 to 12.

Figure 9:
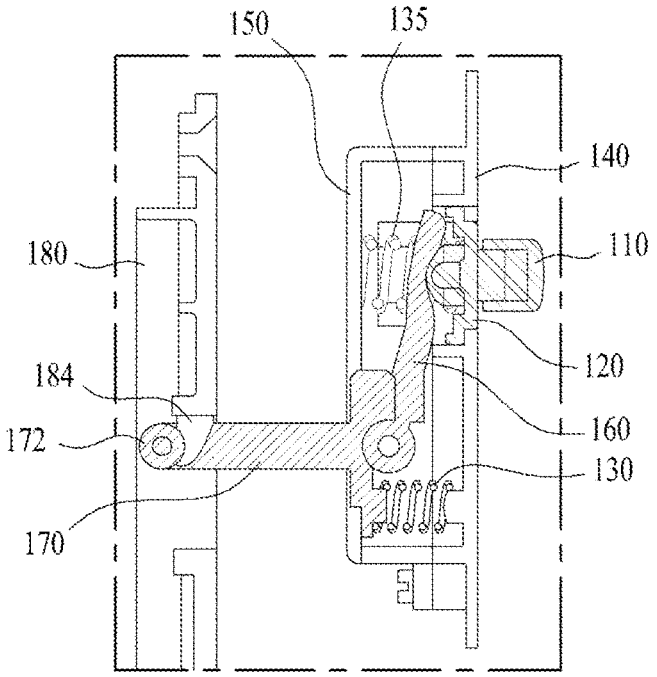
FIGS. 9 to 12 are transverse cross-sectional views illustrating a sequence of operation of the decoupling device.

FIG. 9 shows a normal state of the sub-door 30 in which the sub-door 30 is closed over the main door 40. In this state, the button 110 protrudes from the front surface of the sub-door 30 as the second elastic member 135 pushes the slide member 120. In addition, as the first elastic member 130 pushes the hook member 170, the hook 172 is caught by the locking protrusion 184 and is thus held in a locked state.

When the user pulls the handle 35 of the sub-door 30 in this state, the sub-door 30 is opened by rotating together with the main door 40. Then, the user may access the interior of the fresh food compartment or access the rear side of the auxiliary storage compartment 45. In the repulsive device 190 shown in FIGS. 7 and 8, the elastic member 197 may be in a compressed state as the repulsive member 191 is pressed by the front surface of the main door 40.

Figure 10:
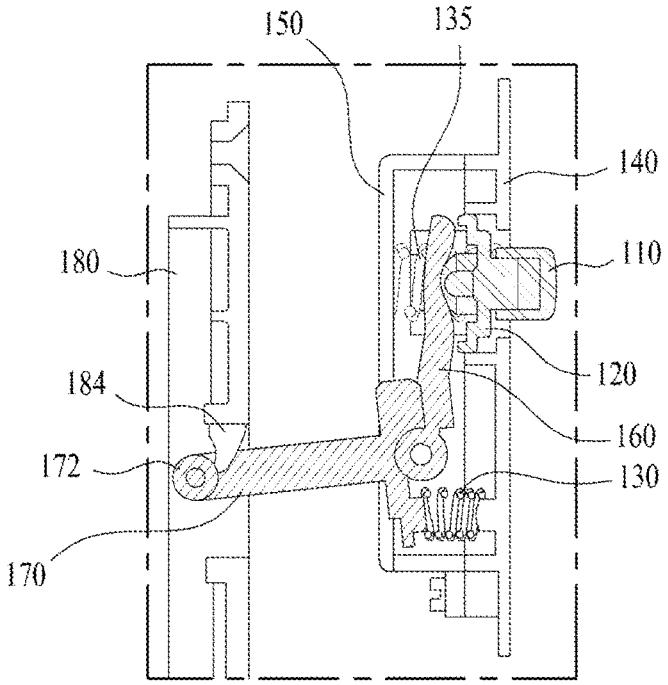

When the user pushes the button 110, the link member 160 is pushed and rotated by the slide member 120, as shown in FIG. 10. At this time, the second elastic member 135 is compressed by the slide member 120. At the same time, the hook member 170 coupled to the link member 160 is also rotated and thus decoupled from the locking protrusion 184. The first elastic member 130 is compressed by the rotating hook member 170.

Figure 11:
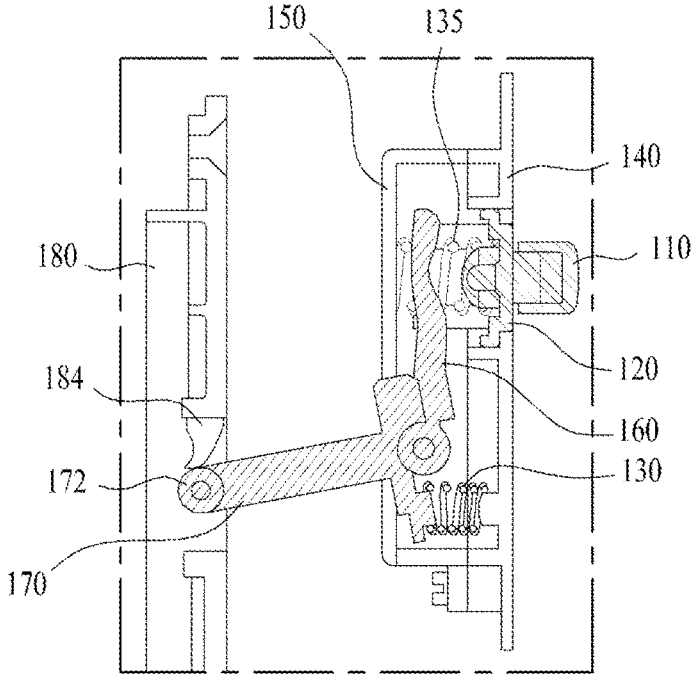

FIG. 11 shows condition of the button 110 immediately after the button 110 is released by the user. First, the slide member 120 is pushed back by the second elastic member 135, and the button 110 coupled to the slide member 120 is pushed back to protrude to the original position thereof. At this time, the first elastic member 130 does not apply elastic force, and thus the hook member 170 and the link member 160 remain in the rotated positions. Accordingly, the hook 172 is positioned under the locking protrusion 184. At the same time, by the elastic force from the elastic member 197 of the repulsive device 190, the sub-door 30 is pushed relative to the main door 40 and thus opened by a predetermined angle. It can be seen from FIG. 11 that the gap between the locking protrusion case 180 and the second case 150 has been widened over the state shown in FIG. 10.

Figure 12:
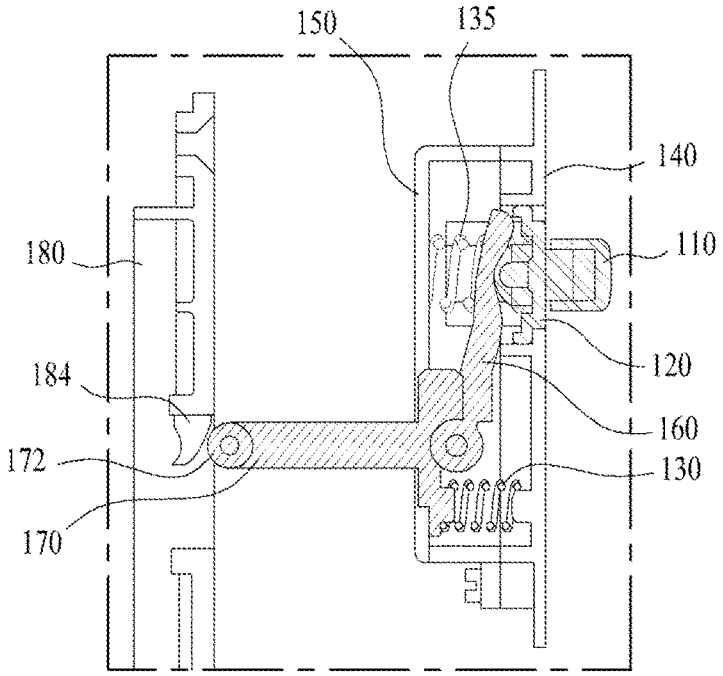

Subsequently, as shown in FIG. 12, the first elastic member 130 applies elastic force and rotates the hook member 170. Thereby, the link member 160 coupled to the hook member 170 rotates until it returns to the original position thereof and contacts the slide member 120. At this time, the hook 172 of the hook member 170 rises up to the level of the locking protrusion 184, but it is fully separated from the locking protrusion and thus positioned at the front. Thereby, when the user pulls the handle 35 of the sub-door 30, only the sub-door 30 is opened by being separated from the main door 40.

As apparent from the above description, a structure to selectively decouple the main door and the sub-door may be simplified and thus easy to fabricate and assemble. Additionally, or alternatively, shock produced in opening and closing the sub-door may be sufficiently endured, and thus risk of damage is low and durability may be enhanced. Additionally, or alternatively, when a user pushes the button without pulling the main door, because the sub-door is spaced a predetermined distance from the main door by the repulsive device, the hook member in the decoupled state may be prevented from being re-coupled to the locking protrusion.

It will be apparent to those skilled in the art that various modifications and variations can be made in the present application without departing from the spirit or scope of the applications. Thus, it is intended that the present application covers the modifications and variations of this application provided they come within the scope of the appended claims and their equivalents.

What is claimed is:

1. A refrigerator comprising:

a cabinet defining a storage compartment;

a main door having a front surface and a rear surface, the main door being rotatably connected to the cabinet and configured to open and close the storage compartment;

an auxiliary storage compartment provided to the rear surface of the main door, an access opening being provided in the main door to allow access to the auxiliary storage compartment from the front surface of the main door;

a sub-door having a front surface and a rear surface, the sub-door being rotatably connected to the main door and configured to open and close the access opening such that, based on the sub-door being oriented in a closed position, the rear surface of the sub-door contacts the front surface of the main door to close the access opening;

a button exposed at the front surface of the sub-door and configured to receive input provided by a user;

a hook member having a pivot shaft mounted to a rear end the hook member, the hook member protruding backward from the rear surface of the sub-door and being configured to rotate within the sub-door about the pivot shaft in response to receipt of user input at the button;

a locking protrusion provided in a groove located on the front surface of the main door and configured to be selectively coupled to the hook member; and a link member coupled to the hook member and configured to rotate together with the hook member in response to receipt of user input at the button.

2. The refrigerator according to claim 1, further comprising a case installed through the sub-door such that the button protrudes from a front surface of the sub-door and the hook member protrudes backward from the sub-door.

3. The refrigerator according to claim 2, further comprising a slide member provided between the button and the link member, the slide member being guided to move back and forth in the case.

4. The refrigerator according to claim 3, wherein the case comprises:

a first case defining a through hole that receives a portion of the button and allows the button to move back and forth, the first case being provided with a guide groove configured to guide movement of the slide member; and a second case that is provided with a pivot shaft hole in which the pivot shaft of the hook member is mounted and that defines an opening allowing the hook member to pass therethrough.

5. The refrigerator according to claim 4, wherein the opening of the second case vertically extends to allow rotation of the hook member.

6. The refrigerator according to claim 4, wherein the slide member is larger than the through hole and restricted by an edge of the through hole such that a maximum distance of forward movement of the slide member is limited.

7. The refrigerator according to claim 3, further comprising a first elastic member and an extension extending from the pivot shaft of the hook member in a direction opposite from the link member, the first elastic member being configured to return the hook member to an original position of the hook member based on locking of the hook member being released.

8. The refrigerator according to claim 7, further comprising a second elastic member provided between an interior of the case and the button, the second elastic member being configured to return the button to an original position of the button following receipt of user input at the button.

9. The refrigerator according to claim 8, wherein the second elastic member is installed through a hole in the link member.

10. The refrigerator according to claim 8, wherein the second elastic member has a higher modulus of elasticity than that of the first elastic member such that the hook member returns to the original position thereof after the button returns to the original position thereof.

11. The refrigerator according to claim 8, wherein the locking protrusion has a shape of a wedge extending downward in the case that is mounted within the main door, and wherein the locking protrusion comprises a convex guide surface provided to a front side thereof and a concave locking surface provided to a back side thereof.

12. The refrigerator according to claim 11, wherein the hook member defines a through hole allowing the locking protrusion to be selectively inserted in the through hole and includes a cylindrical hook provided to an end of the hook member.

13. The refrigerator according to claim 12, wherein the hook member further comprises a body part horizontally extending from the pivot shaft, a front portion of the body part being formed in a shape of a bracket, wherein the hook is rotatably mounted to a front end of the body part.

14. The refrigerator according to claim 12, wherein a distance from the pivot shaft of the hook member to the hook is at least twice a distance from the pivot shaft to a point on the extension that intersects a straight line passing through a center of the first elastic member.

15. The refrigerator according to claim 3, wherein an inner surface of the case is provided with a guide groove arranged in a horizontal direction, wherein the slide member comprises a guide protrusion slidably guided by the guide groove.

16. The refrigerator according to claim 3, further comprising a cover mounted in an opening in the rear surface of the sub-door to allow the case to be mounted, wherein the cover defines a through hole extending vertically to allow rotation of the hook member through the cover.

17. The refrigerator according to claim 1, further comprising a repulsive device provided to the sub-door or the main door to cause the sub-door to be spaced a predetermined distance from the main door based on the hook member and the locking protrusion being decoupled from each other in response to receipt of user input at the button.

18. The refrigerator according to claim 17, wherein the repulsive device comprises:

a case defining a through hole at one side of the case;

a repulsive member arranged in the case such that a front portion of the repulsive member is guided to protrude through the through hole; and an elastic member provided in the case and configured to push the repulsive member toward the through hole.

19. The refrigerator according to claim 1, wherein the button is configured to receive input by being pushed by the user.

* * * * *